US005558496A

United States Patent [19]

Woodmansee et al.

[11] Patent Number: 5,558,496

[45] Date of Patent: Sep. 24, 1996

[54] REMOVING PARTICLES FROM GAS TURBINE COOLANT

[75] Inventors: Donald E. Woodmansee; Diether E. Carreno, both of Schenectady, N.Y.

[73] Assignee: General Electric Company, Schenectady, N.Y.

[21] Appl. No.: 517,310

[22] Filed: Aug. 21, 1995

[51] Int. Cl.[6] ..... F01D 5/08; F01D 5/18

[52] U.S. Cl. ..... 416/95; 416/96 R; 416/198 A; 415/115; 415/121.2; 415/169.1

[58] Field of Search ..... 415/115, 116, 415/121.2, 169.1; 416/95, 96 R, 96 A, 97 R, 198 A; 60/39.464

[56] References Cited

U.S. PATENT DOCUMENTS

| | | | |
|---|---|---|---|
| 2,393,963 | 2/1946 | Berger | 416/96 R |
| 2,778,601 | 1/1957 | Eckert | 416/96 R |
| 5,049,032 | 9/1991 | Brandon . | |
| 5,080,556 | 1/1992 | Carreno . | |
| 5,111,663 | 5/1992 | Brandon . | |
| 5,253,976 | 10/1993 | Cunha . | |
| 5,318,404 | 6/1994 | Carreno et al. . | |
| 5,320,483 | 6/1994 | Cunha et al. . | |

FOREIGN PATENT DOCUMENTS

| | | | |
|---|---|---|---|
| 0978608 | 4/1951 | France | 416/95 |
| 0765225 | 1/1957 | United Kingdom | 416/96 R |

*Primary Examiner*—F. Daniel Lopez
*Assistant Examiner*—Christopher Verdier
*Attorney, Agent, or Firm*—Paul R. Webb, II

[57] ABSTRACT

Particulates are removed from the coolant used to cool gas turbines by subjecting the coolant to the centrifugal acceleration of the gas turbine rotor. Axially oriented channels are formed in the rotor at a radial distance from its longitudinal axis. The channels are in fluid communication with a coolant supply passage so that coolant coming onboard the rotor will first pass through the channels. The high centrifugal force produced by rotor rotation causes particulates in the coolant passing through the channel to move radially outward and deposit on a fixed surface in the channel. Thus, the particulates are collected in the channel and removed from the coolant discharged from the channel. The channels may be provided with removable liners.

10 Claims, 5 Drawing Sheets

REMOVING PARTICLES FROM GAS TURBINE COOLANT

BACKGROUND OF THE INVENTION

This invention relates generally to internal cooling in gas turbine devices and more particularly to removing contaminants from the cooling medium prior to its entry into gas turbine cooling passages.

The traditional approach to cooling gas turbines has been to extract air from the gas turbine compressor and direct the air to the rotating and static turbine parts which are immersed in the hot combustor discharge gas. This has typically been accomplished, particularly for rotating part cooling, in an open cycle in which the cooling air is routed through the interior of the part (such as a turbine blade) and is then discharged into the working fluid. However, requirements for high efficiency and output in modern gas turbines have resulted in significant increases in operating temperatures which present a need for improved gas turbine cooling. Thus, it has become desirable to employ closed cycle cooling using steam as a cooling medium because its absorbed heat can be recovered through expansion in a steam turbine. Steam is readily available at several temperature and pressure levels in a combined cycle operation. However, the use of steam as a coolant could be limited by the tendency of solid particle contaminants in the steam to deposit in areas of high heat transfer, causing coolant flow blockage and metal overheating. Similarly, other coolants, such as air or Helium, could have corresponding problems due to solid impurities. The small cooling passages formed in the rotor blades are particularly susceptible to such plugging because the high centrifugal force drives the contaminants to the outer surfaces of these passages very quickly.

Therefore, it is necessary to clean the cooling medium as well as possible prior to entry into the cooling passages. Known techniques for removing particulates from fluids include filtration, magnetic separation and electrostatic precipitation. Filtration systems capable of achieving adequate filtration offboard are available, but the high pressure drop produced by such systems would compromise overall plant performance. Magnetic separation only removes ferromagnetic materials effectively and any momentary failure of the magnet would release contaminants into the gas turbine. Electrostatic precipitation has been found to be impractical for cleaning such coolants because operation of charged media at high pressures has been found to be difficult.

Accordingly, there is a need for reliably removing contaminants from gaseous coolants without producing a significant pressure loss.

SUMMARY OF THE INVENTION

The above-mentioned needs are met by the present invention which provides a gas turbine apparatus comprising a rotor having a longitudinal axis and a coolant supply passage. At least one axially oriented channel is formed in the rotor at a radial distance from the longitudinal axis where centrifugal acceleration forces are high. The channel is in fluid communication with the coolant supply passage so that coolant coming onboard the rotor will first pass through the channel. The high centrifugal force produced by rotor rotation causes particulates in the coolant passing through the channel to move radially outward and deposit on a fixed surface in the channel. Thus, the particulates are collected in the channel and removed from the coolant discharged at the end of the channel. More than one channel may be used, and the channels can be provided with removable liners to facilitate deposit removal. A second, optional structure is also described which would collect any deposit material which may dislodge from the cleaner channels during system operation.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
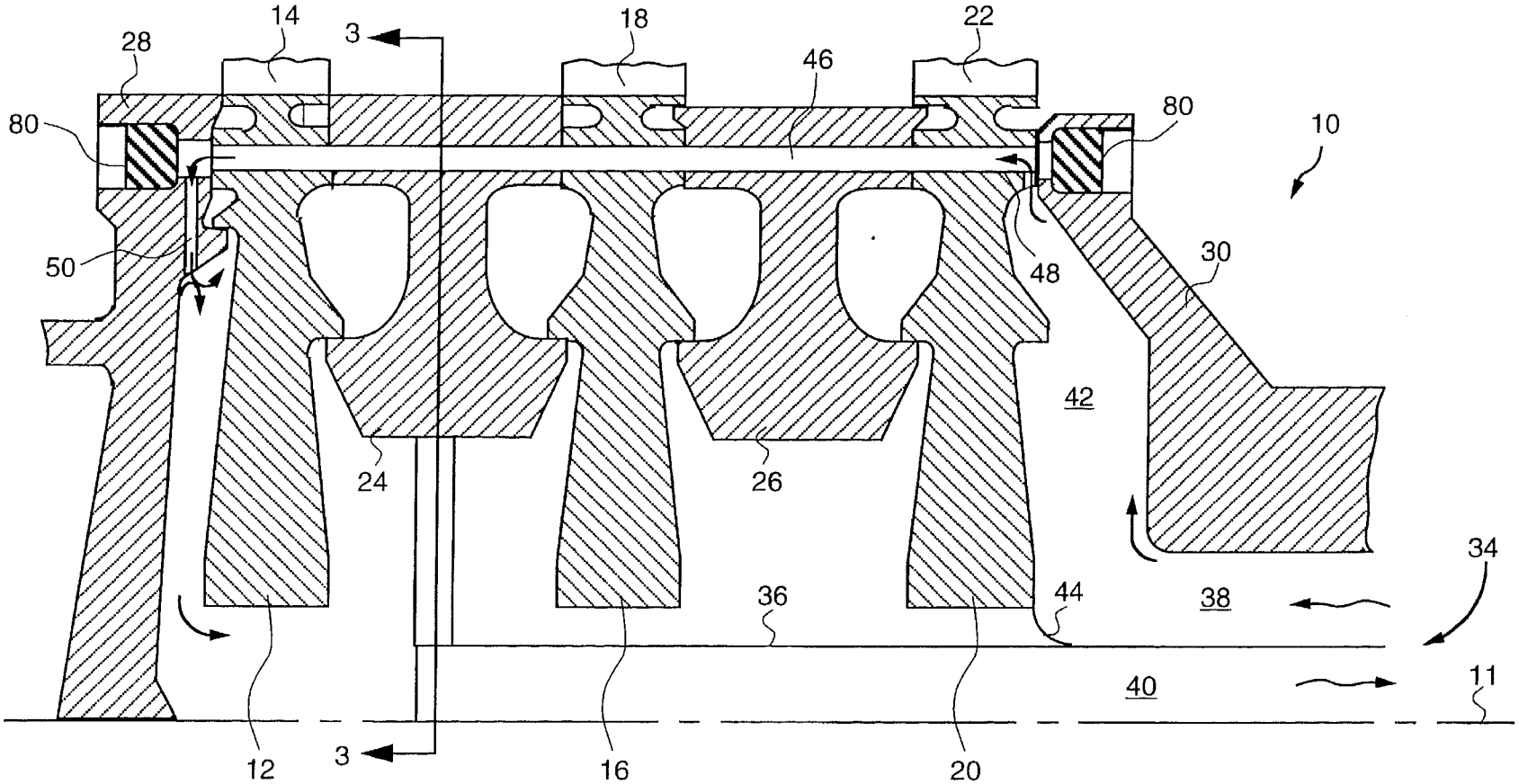
FIG. 1 is a fragmentary cross-sectional view taken along line 1—1 of FIG. 3 of a gas turbine in accordance with the present invention.
Figure 2:
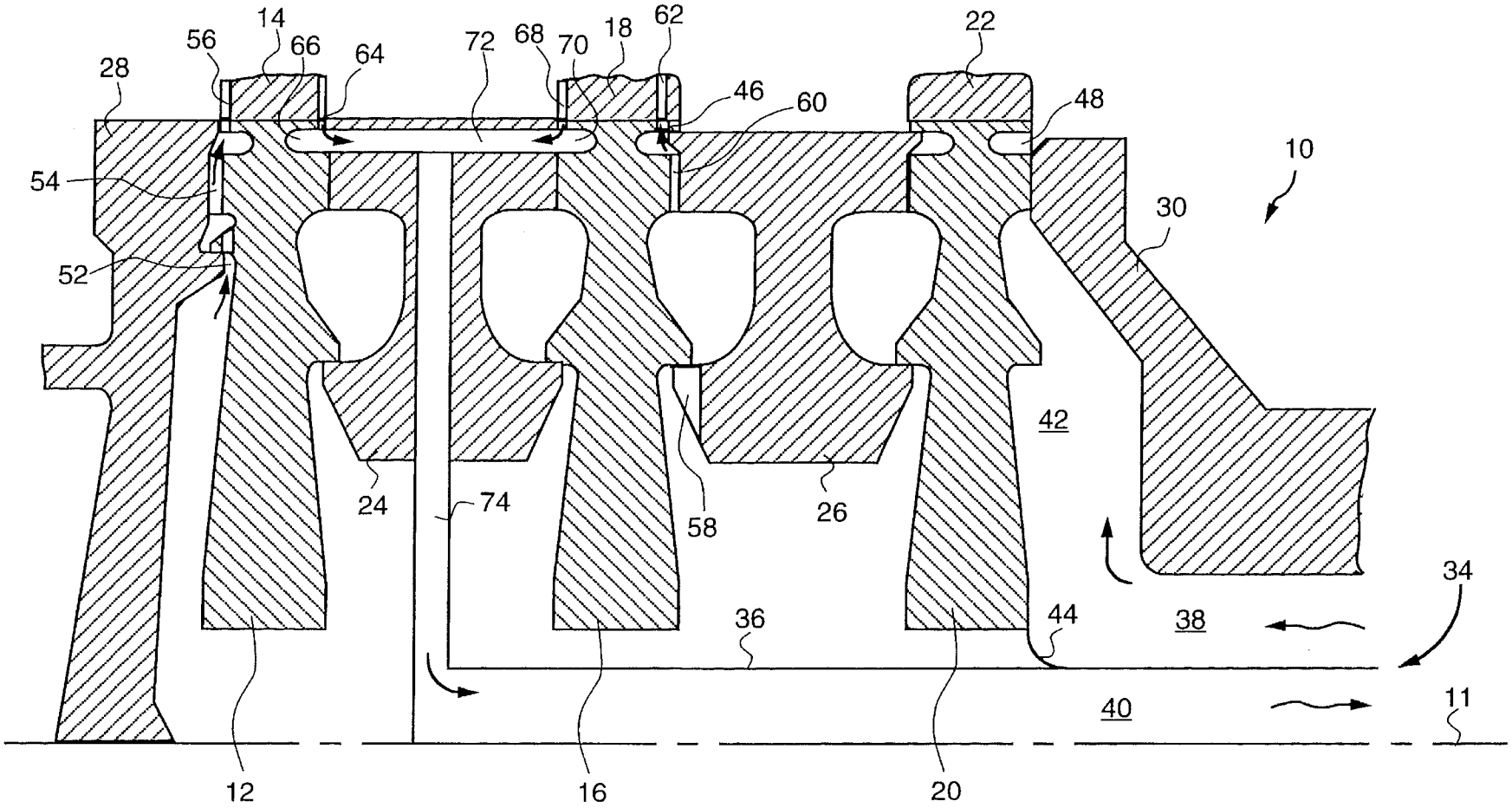
FIG. 2 is a fragmentary cross-sectional view taken along line 2—2 of FIG. 3 of a gas turbine in accordance with the present invention.
Figure 3:
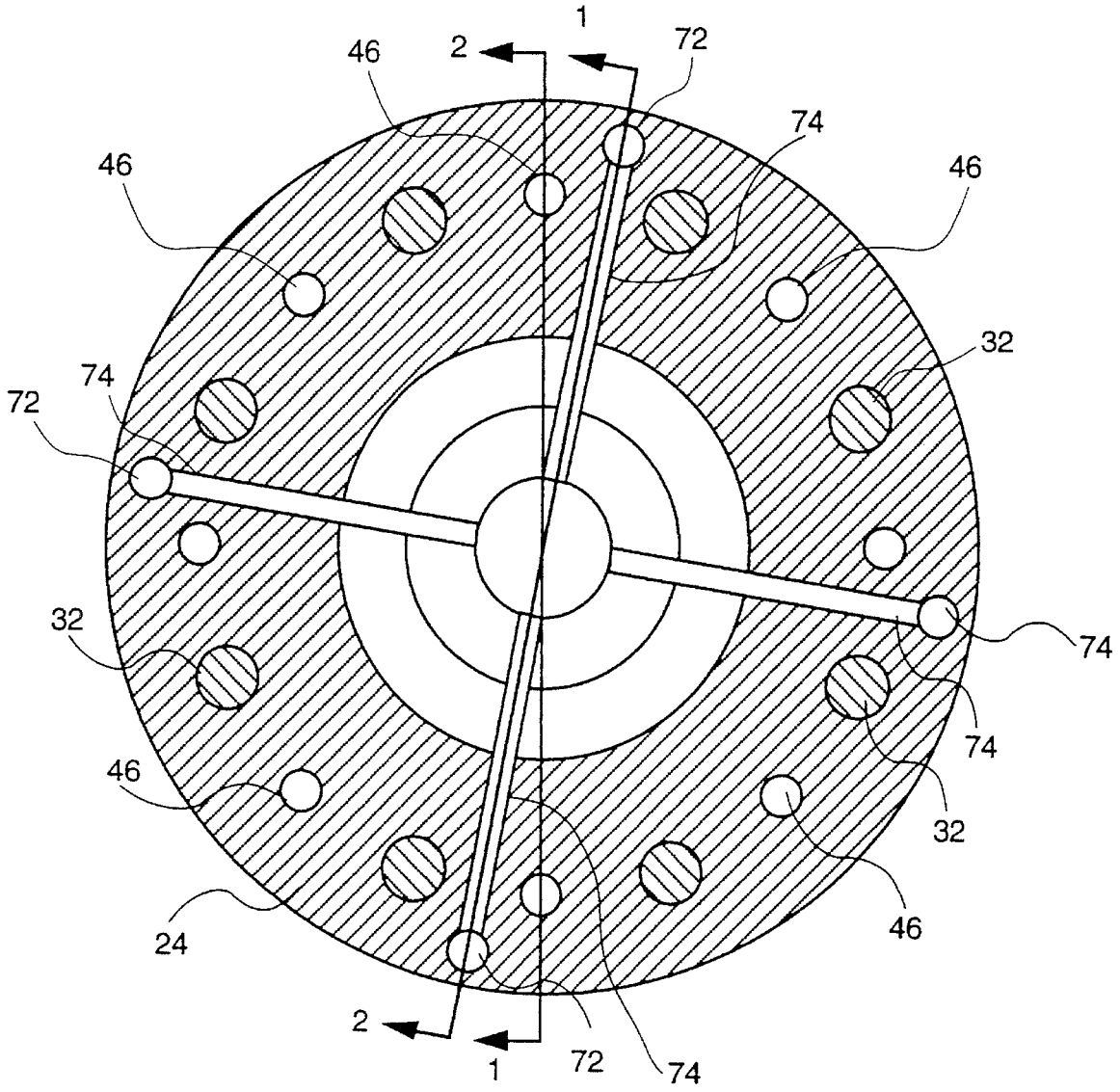
FIG. 3 is a cross-sectional end view taken along line 3—3 of FIG. 1 of a gas turbine rotor in accordance with the present invention.

Referring to the drawings wherein identical reference numerals denote the same elements throughout the various views, FIGS. 1–3 show a portion of the rotor structure 10 of a gas turbine, which is preferably a combined cycle gas turbine. The gas turbine includes a compressor, combustors, an outer casing and other ancillary structure which are conventional and well known in the art and thus not shown in FIGS. 1–3. As illustrated in FIGS. 1 and 2, the rotor 10 includes three turbine stages, although the present invention is also applicable to turbines having fewer or more stages. Each stage includes a plurality of turbine blades mounted to the outer periphery of a rotor wheel. Thus, the rotor 10 includes a first rotor wheel 12 supporting turbine blades 14, a second rotor wheel 16 supporting turbine blades 18 and a third rotor wheel 20 supporting turbine blades 22.

A first spacer disc 24 is disposed between the first rotor wheel 12 and the second rotor wheel 16, and a second spacer disc 26 is disposed between the second rotor wheel 16 and the third rotor wheel 20. The rotor wheels 12, 16 and 20 and the spacer discs 24 and 26 are situated in abutting relation with one another between a forward flange 28 and an aft flange 30. Rotor tie bolts 32 (FIG. 3) disposed around the rotor 10 in a bolt circle extend through the flanges 28 and 30, the rotor wheels 12, 16 and 20 and the spacer discs 24 and 26 to secure these elements such that they are able to rotate together about the longitudinal axis 11 of the rotor 10.

The turbine blades 14 and 18 of the first two stages are provided with internal passages through which a cooling medium can flow to cool these blades. Such internal passages are well known in the art and need not be explained further. The present invention is particularly useful in removing particulates from steam coolant available in combined cycle gas turbines. However, other coolants such as air, hydrogen and inert gases such as Helium are also cleanable using the present invention. The coolant is ducted onboard the rotor 10 through a conventional rotary coupling (not shown) located at the aft end of the rotor assembly 10. The aft flange 30 is provided with a central opening 34. A cylindrical duct 36 is positioned along the longitudinal axis 11 and has a closed end located near the forward end of the rotor 10 and an open end located in the opening 34. The duct 36 thus forms two concentric passages, a coolant supply passage 38 and a coolant return passage 40. The coolant supply passage 38 is in fluid communication with the cavity 42 defined between the aft flange 30 and the third rotor wheel 20. An annular seal member 44 is provided between the outer surface of the duct 36 and the third rotor wheel 20 to seal off the coolant supply passage 38 from the rest of the rotor interior space.

In accordance with the present invention, a plurality of axial channels 46 are formed in the rotor 10 for the purpose of cleansing the coolant prior to its entry into the internal cooling passages of the partially drawn first and second stage turbine blades 14 and 18. As shown in FIG. 1, the channels 46 preferably extend the entire length of the rotor 10, substantially parallel to the longitudinal axis 11. The channels 46 are interspersed with the tie bolts 32 around the bolt circle and are thus radially spaced from the longitudinal axis 11. Passages 48 are formed in the third rotor wheel 20 adjacent to the aft end of each channel 46 so that the channels 46 are in fluid communication with the cavity 42 defined between the aft flange 30 and the third rotor wheel 20 and thus the coolant supply passage 38. Additional passages 50 are formed in the forward flange 28 to provide fluid communication between each of the channels 46 and the wheel spaces defined in the interior of the rotor 10. Thus, coolant entering the coolant supply passage 38 will pass through the channels 46 and then flood the interior wheel spaces.

As seen in FIG. 2, passages 52 and 54 are formed in the first rotor wheel 12 so that the interior wheel spaces are in fluid communication with the coolant inlets 56 of the first stage turbine blades 14. Similarly, passages 58 are formed in the second spacer disc 26, and passages 60 are formed in the second rotor wheel 16. The passages 58 and 60 provide fluid communication between the interior wheel spaces and the coolant inlets 62 of the second stage turbine blades 18. The coolant outlets 64 of the first stage turbine blades 14 are in fluid communication with an annular groove 66 formed in the first rotor wheel 12, and the coolant outlets 68 of the second stage turbine blades 18 are in fluid communication with an annular groove 70 formed in the second rotor wheel 16.

Axial passages 72 are formed in the first spacer disc 24. The passages 72 extend through the entire thickness of the first spacer disc 24 and are radially positioned so as to be aligned with the annular grooves 66 and 70 in the first and second rotor wheels 12 and 16, respectively. A return tube 74 extends radially inward from each axial passage 72 through the first spacer disc 24 and intersects the outer surface of the cylindrical duct 36 at or near its closed end. Thus, the coolant outlets 64 and 68 are placed in fluid communication with the coolant return passage 40. FIG. 3 shows four axial passages 72 and return tubes 74, but this is only for purposes of illustration; more or less of these elements can be used.

Figure 4:
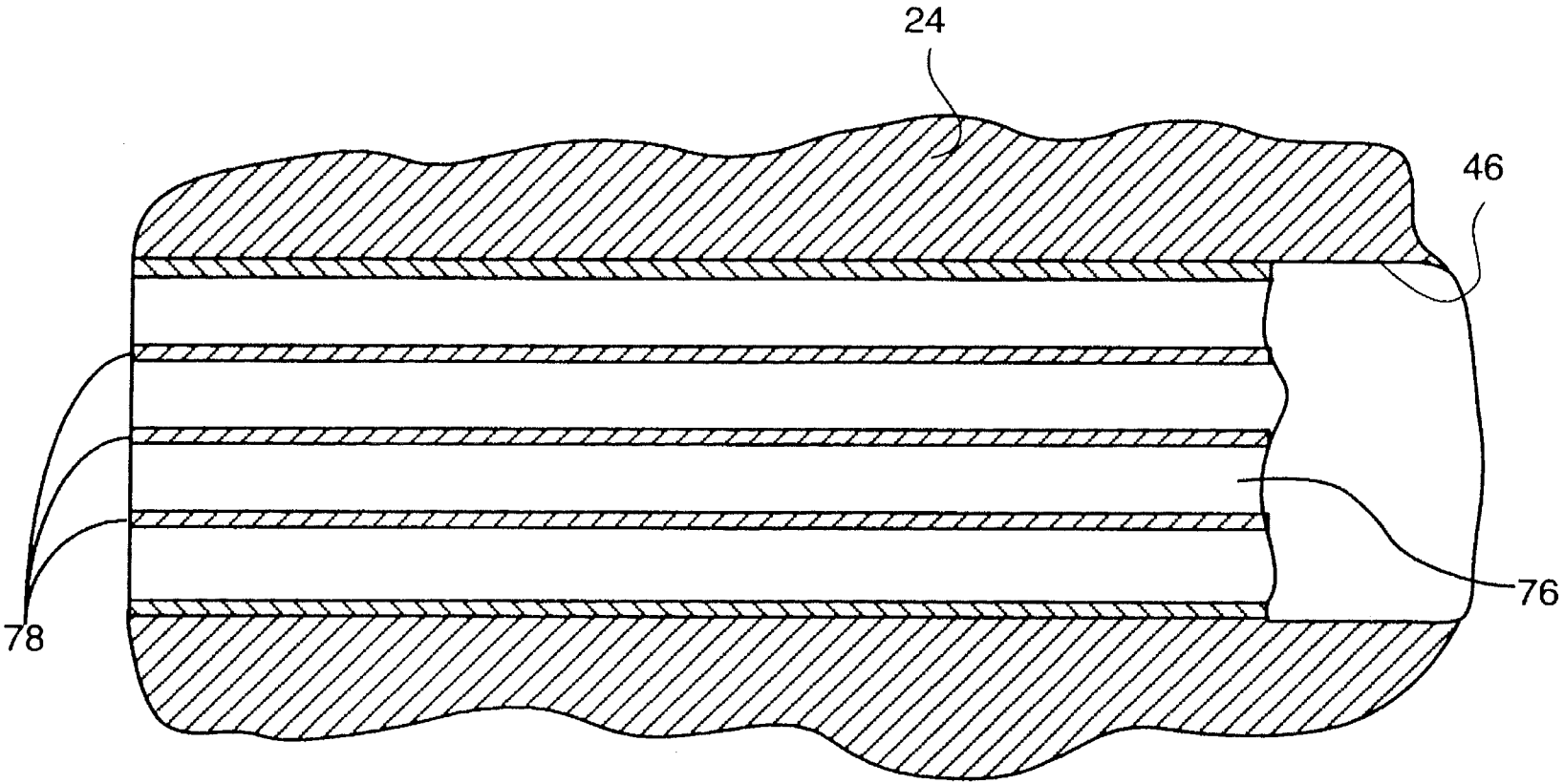
FIG. 4 is a fragmentary cross-sectional view of a channel insert of the present invention.

Preferably, the channels 46 are provided with removable liners 76; a cut-away portion of a liner 76 extending through the first spacer disc 24 being shown in FIG. 4. The liners 76 are made of a material having low thermal conductivity so as to insulate the coolant in the channels 46 from the rotor 10. The liners 76 are also provided with shelves 78 extending axially therein. The addition of the shelves 78 lessen the radial distance particles need to travel to deposit on a channel surface and also create more surface area to collect deposits. Such multishelved deposit collectors are well known in the liquid clarifier industry as chevron separators, but they are used here in a novel application for gas cleaning. The liners 76 can be removed through channel openings in either the forward flange 28 or the aft flange 30. During operation of the turbine, these openings in the forward and aft flanges 28 and 30 are closed with plugs 80 (FIG. 1).

In operation, a coolant such as steam is ducted onboard the rotor 10 through a conventional rotary coupling located at the aft end of the rotor 10. As seen in FIG. 1, the coolant enters through the coolant supply passage 38 and flows through the cavity 42 defined between the aft flange 30 and the third rotor wheel 20. The coolant then enters into the aft end of the channels 46 through the passages 48 and flows longitudinally through the channels 46. As the coolant passes through the channels 46, the particulates in the coolant are exposed to the high centrifugal force caused by rotation of the rotor 10 and move radially outward until contacting a fixed surface of the channel liner 76. Thus, the particulates are collected on the channel liners 76, and clean coolant exits the channels via the passages 50 formed in the front flange 28.

The clean coolant discharged from the passages 50 floods the wheel spaces in the interior of the rotor 10. As seen in FIG. 2, coolant from the wheel spaces enters the coolant inlets 56 of the first stage turbine blades 14 via the passages 52 and 54 and the coolant inlets 62 of the second stage turbine blades 18 via the passages 58 and 60. After passing through the internal passages of the turbine blades 14 and 18, the coolant, at an elevated temperature, is discharged through the coolant outlets 64 and 68 and passes through the annular grooves 66 and 70, respectively, to the axial passages 72. From the axial passages 72, the coolant flows through the return tubes 74 to the coolant return passage 40 and is taken offboard the rotor 10 through another rotary coupling located at the aft end of the rotor 10.

The particulates are removed from the rotor 10 by periodically removing the liners 76 during outages and inserting clean liners before the system is put back online. To maximize the time between turbine shut downs for deposit removal, the coolant can be precleaned offboard the rotor 10. Large particulates can be removed from the coolant using standard filtration technology without suffering an excessive pressure loss. This minimizes the amount of deposit the liners 76 need to collect and allows the turbine to be operated longer before deposits need to be removed.

The sizing of the channel 46 and the liner 76 is a function of the particle settling velocity (i.e., the radial velocity), and the time the coolant is in the channels 46. The radial velocity is determined by particle size, properties of the cooling medium, and the local radial acceleration provided by the rotor rotation rate, and the time the coolant is in the channels 46 is determined by the length of the channels 46 and the mass flow rate of the coolant through the channels 46. Thus, for a given radial velocity, the distance which the particles must move radially to reach a fixed collection surface cannot exceed the distance the particles will move radially in the time the coolant is in the channels 46.

While the present invention has been described as cleaning the coolant used to cool the rotor, it should also be noted that the stator portions of a gas turbine could also be cooled by coolant which has been centrifugally cleaned on the rotor. This would require one additional rotary coupling (making a total of 3) for taking some of the clean coolant offboard the rotor before the coolant is delivered to the turbine blades.

Figure 5:
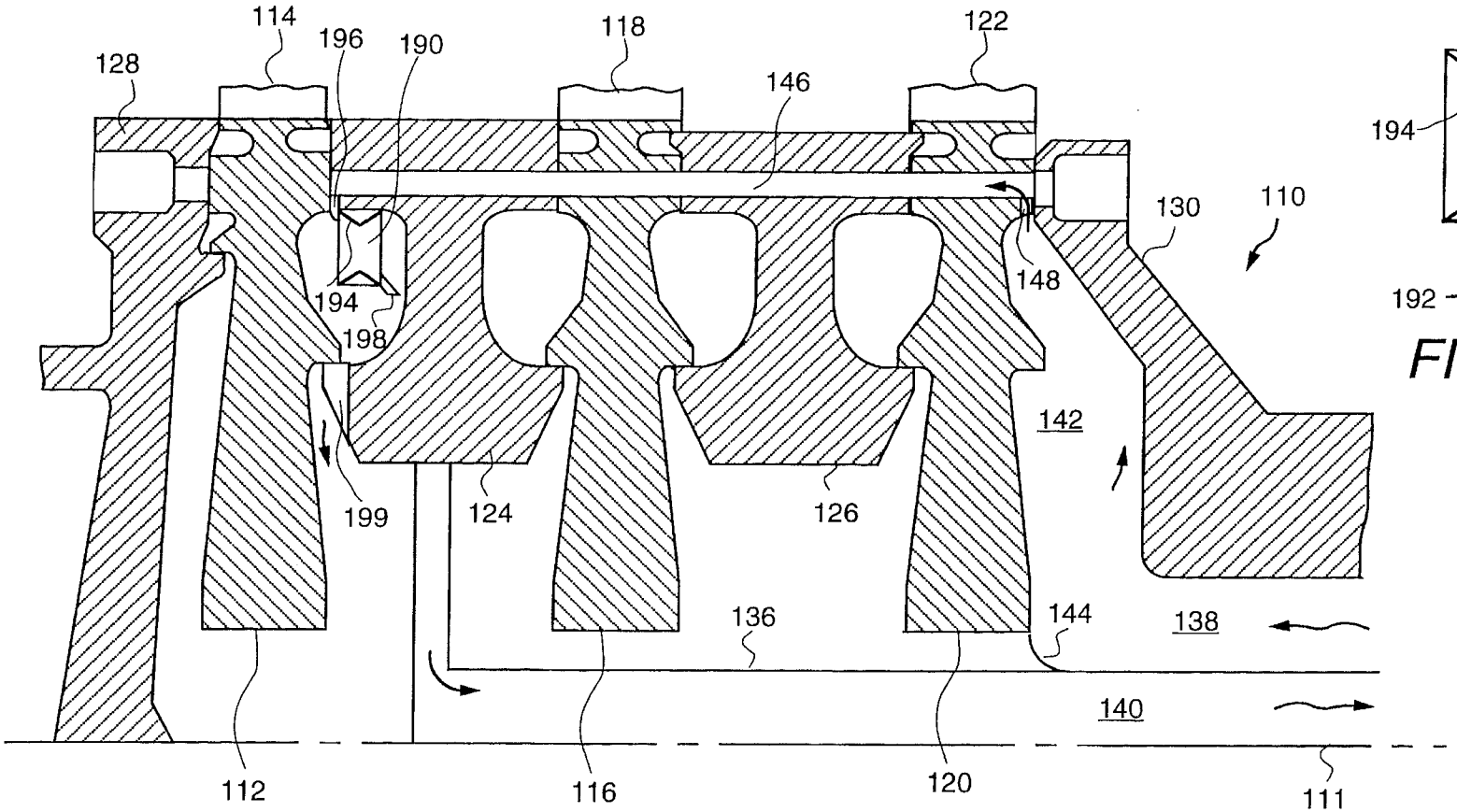
FIG. 5 is a fragmentary cross-sectional view of a second embodiment of the present invention.

Turning to FIG. 5, a second embodiment of the present invention is shown. The second embodiment comprises a gas turbine rotor 110 which, like the first embodiment, includes a first rotor wheel 112 with turbine blades 114, a second rotor wheel 116 with turbine blades 118, a third rotor wheel 120 with turbine blades 122, first and second spacer discs 124 and 126, and forward and aft flanges 128 and 130. A cylindrical duct 136 positioned along the longitudinal axis 111 of the rotor 110 forms two concentric passages, a coolant supply passage 138 and a coolant return passage 140. The coolant supply passage 138 is in fluid communication with the cavity 142 defined between the aft flange 130 and the third rotor wheel 120. An annular seal member 144 is provided between the outer surface of the duct 136 and the third rotor wheel 120 to seal off the coolant supply passage 138 from the rest of the rotor interior space.

A plurality of axial channels 146 is formed in the rotor 110 for the purpose of cleansing the coolant prior to its entry into the internal cooling passages of the first and second stage turbine blades 114 and 118. As shown in FIG. 5, the channels 146 extend the from the aft flange 130 to the first rotor wheel 112, substantially parallel to the longitudinal axis 111. Passages 148 are formed in the third rotor wheel 120 adjacent to the aft end of each channel 146 so that the channels 146 are in fluid communication with the cavity 142 and thus the coolant supply passage 138.

Figure 6:
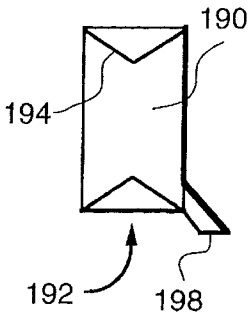
FIG. 6 is a cross-sectional view of a deposit trap.

As shown in FIGS. 5 and 6, a plurality of deposit traps 190, one corresponding to each channel, is provided in the cavity 192 between the first rotor wheel 112 and the first spacer disc 124. The deposit traps 190 are cylindrical cans having their longitudinal axes positioned radially with respect to the rotor 110. Baffle 194 is provided at each end of the cylindrical can. Additional passages 196 are formed in the first spacer disc 124 to provide fluid communication between each of the channels 146 and the corresponding deposit trap 190. The passages 196 are offset with respect to the longitudinal axes of the deposit traps 190 so as to impart swirl to the coolant flowing into the deposit traps 190. Each deposit trap 190, acting as cyclone separators, has an outlet passage 198 to provide fluid communication between the deposit traps 190 and the cavity 192. Additional passages 199 are formed in the first spacer disc 124 to provide fluid communication between the cavity 192 and the wheel spaces defined in the interior of the rotor 110. Thus, coolant entering the coolant supply passage 138 will pass through the channels 146 and the traps 190 and then flood the interior wheel spaces.

In operation, a coolant is ducted onboard the rotor 110 through a conventional rotary coupling located at the aft end of the rotor 110. As in the first embodiment, the coolant enters into the aft end of the channels 146 through the coolant supply passage 138, the cavity 142 and the passages 148. The particulates in the coolant passing through the channels 146 are exposed to the high centrifugal force caused by rotation of the rotor 110 and move radially outward until contacting a fixed collection surface. Thus, in steady-state operation, the particulates are collected in the channels 146, and clean coolant exits the channels 146 via the passages 196. However, some of the channel deposits may dislodge during transient operations and escape from the channels 146. Any such dislodged deposits will be caught in the deposit traps 190 and move under centrifugal force to the outer ends of the deposit traps 190. The baffles 194 at each end of the cyclone will prevent the dislodged deposits from falling back into the coolant stream at times of slow rotor rotation.

The clean coolant discharged from the outlet passages 198 floods the wheel spaces in the interior of the rotor 110 via the passages 199. Coolant from the wheel spaces is delivered to the first and second stage turbine blades 114 and 118, passes through the turbine blades 114 and 118 and is then taken offboard the rotor 110 through the coolant return passage 140 in the same manner as shown in FIG. 2 with respect to the first embodiment.

The foregoing has described a system removing contaminants from gas turbine coolants without producing a significant pressure loss. While specific embodiments of the present invention have been described, it will be apparent to those skilled in the art that various modifications thereto can be made without departing from the spirit and scope of the invention as defined in the appended claims.

What is claimed is:

1. A gas turbine apparatus comprising:

a rotor having a longitudinal axis, a coolant supply passage and a coolant return passage;

a channel formed axially in said rotor parallel to and radially spaced from said longitudinal axis, one end of said channel being in fluid communication with said coolant supply passage; and a turbine blade attached to said rotor and having a coolant inlet and a coolant outlet, said coolant inlet being in fluid communication with said channel and said coolant outlet being in fluid communication with said coolant return passage.

2. The gas turbine apparatus of claim 1 wherein said channel extends the entire length of said rotor.

3. The gas turbine apparatus of claim 1 further comprising a removable liner disposed in said channel.

4. The gas turbine apparatus of claim 3 wherein said liner is made of a material having low thermal conductivity.

5. The gas turbine apparatus of claim 3 wherein said liner has at least one shelf formed therein.

6. The gas turbine apparatus of claim 1 further comprising additional channels formed axially in said rotor parallel to and radially spaced from said longitudinal axis, one end of each one of said additional channels being in fluid communication with said coolant supply passage.

7. The gas turbine apparatus of claim 1 further comprising a deposit trap disposed in said rotor, said deposit trap being in fluid communication with said channel.

8. A gas turbine apparatus comprising:

a rotor having a longitudinal axis and a coolant supply passage;

an axially oriented channel formed in said rotor and radially spaced from said longitudinal axis, said channel being in fluid communication with said coolant supply passage; and a removable liner disposed in said channel.

9. The gas turbine apparatus of claim 8 wherein said liner is made of a material having low thermal conductivity.

10. The gas turbine apparatus of claim 8 wherein said liner has at least one shelf formed therein.

* * * * *